US007246504B2

(12) United States Patent
Hirano et al.

(10) Patent No.: US 7,246,504 B2
(45) Date of Patent: Jul. 24, 2007

(54) METHOD OF MANUFACTURING REFRIGERATED REPOSITORIES AND SALES MANAGEMENT SYSTEM FOR REFRIGERATED STORAGE

(75) Inventors: Akihiko Hirano, Aichi (JP); Shinichi Kaga, Aichi (JP)

(73) Assignee: Hoshizaki Denki Co., Ltd., Aichi (JP)

( * ) Notice: Subject to any disclaimer, the term of this patent is extended or adjusted under 35 U.S.C. 154(b) by 333 days.

(21) Appl. No.: 10/978,390

(22) Filed: Nov. 2, 2004

(65) Prior Publication Data

US 2005/0092012 A1 May 5, 2005

(30) Foreign Application Priority Data

Nov. 5, 2003 (JP) ..... 2003-375907

(51) Int. Cl.

| | |
|---|---|
| ***F25D 19/00*** | (2006.01) |
| ***F25B 45/00*** | (2006.01) |
| ***F25B 41/06*** | (2006.01) |
| ***F25B 41/04*** | (2006.01) |
| ***G06F 9/46*** | (2006.01) |
| ***G05B 19/418*** | (2006.01) |

(52) U.S. Cl. ..... 62/298; 62/77; 62/222; 236/92 B; 705/8

(58) Field of Classification Search ..... 62/298; 700/112; 705/28, 29
See application file for complete search history.

(56) References Cited

U.S. PATENT DOCUMENTS 6,119,478 A * 9/2000 Sada et al. ..... 62/434
2003/0208418 A1* 11/2003 Caputo et al. ..... 705/28

FOREIGN PATENT DOCUMENTS

JP 06-347159 12/1994

* cited by examiner

*Primary Examiner*—Edward K. Look
*Assistant Examiner*—Michael J. Early
(74) *Attorney, Agent, or Firm*—Wenderoth, Lind & Ponack, L.L.P.

(57) ABSTRACT

A method of manufacturing cooling storage units and a sales management system is to be provided for the same permitting the exclusion of a made-to-order production system which indispensably requires pre-shipment cooling tests. Thermally insulated boxes of different predetermined sets of specifications, each usable as a freezer, a refrigerator, or a freezer-refrigerator, and cooling units so fabricated as to have a prescribed cooling capacity for any one of the group of thermally insulated boxes are made ready in advance. One thermally insulated box, meeting the specified requirements from the group of thermally insulated boxes, and a matching cooling unit are transported to the installation site of the cooling storage unit. The thermally insulated box and the cooling unit are combined at the installation site to constitute the cooling storage unit.

6 Claims, 15 Drawing Sheets

Fig.2

DATA STRUCTURE OF BOX DB

| BOX ID | COOLING REQUIREMENT | VERTICAL or LATERAL | NUMBER OF DOORS | TYPE OF DOORS | WIDTH (mm) | LENGTH (mm) | EFFECTIVE CAPACITY (L) | REQUIRED NUMBER OF COOLING UNITS |
|---|---|---|---|---|---|---|---|---|
| R0001 | refrigerating | vertical | 2 | stainless steel | 625 | 850 | 528 | 1 |
| R0002 | refrigerating | vertical | 2 | stainless steel | 750 | 850 | 658 | 1 |
| R0003 | refrigerating | vertical | 4 | stainless steel | 1200 | 850 | 1115 | 2 |
| R0004 | refrigerating | vertical | 2 | stainless steel | 625 | 650 | 382 | 1 |
| R0005 | refrigerating | vertical | 2 | glass | 625 | 650 | 382 | 1 |
| ----- | ----- | ----- | ----- | ----- | ----- | ----- | ----- | ----- |
| RT0001 | refrigerating | lateral | 2 | stainless steel | 1200 | 600 | 240 | 1 |
| RT0002 | refrigerating | lateral | 2 | stainless steel | 1200 | 750 | 319 | 1 |
| ----- | ----- | ----- | ----- | ----- | ----- | ----- | ----- | ----- |
| F0001 | freezing | vertical | 2 | stainless steel | 625 | 650 | 373 | 1 |
| F0002 | freezing | vertical | 2 | stainless steel | 750 | 650 | 468 | 2 |
| F0003 | freezing | vertical | 2 | stainless steel | 750 | 800 | 604 | 2 |
| ----- | ----- | ----- | ----- | ----- | ----- | ----- | ----- | ----- |
| RF0001 | freezing-refrigerating | vertical | 2 | stainless steel | 625 | 800 | 441 | 2 |
| RF0002 | freezing-refrigerating | vertical | 2 | stainless steel | 625 | 650 | 437 | 2 |
| ----- | ----- | ----- | ----- | ----- | ----- | ----- | ----- | ----- |

Fig.3

DATA STRUCTURE OF RECEIVED ORDER DB

| Received Order ID | RESPONSIBLE SALES REPRESENTATIVE | CUSTOMER'S NAME | SHIPPING DESTINATION | COOLING REQUIREMENT | VERTICAL or LATERAL | NUMBER OF DOORS | TYPE OF DOORS | WIDTH (mm) | EFFECTIVE CAPACITY (L) | NO. OF UNITS ORDERED |
|---|---|---|---|---|---|---|---|---|---|---|
| 3111298 | X | OO Co., Ltd | ···Chiyoda-ku, Tokyo | refrigerating | vertical | 2 | stainless steel | 625 | 382 | 1 |
| 3111299 | Y | Restaurant YY Ltd. | ···Minato-ku, Tokyo | refrigerating | vertical | 4 | stainless steel | 1200 | 1115 | 2 |
| 3111300 | X | XX Co., Ltd. | ···Kita-ku, Osaka | freezing | vertical | 2 | stainless steel | 625 | 373 | 8 |
| 3111301 | Z | ZZ Co., Ltd. | ···Nakamura-ku, Nagoya | freezing | vertical | 2 | stainless steel | 750 | 468 | 1 |
| 3111302 | X | Cafeteria XX | ···Nada-ku, Kobe | freezing-refrigerating | vertical | 4 | stainless steel | 600 | 542 | 1 |
| 3111303 | X | Cafeteria XX | ···Nada-ku, Kobe | freezing-refrigerating | vertical | 2 | stainless steel | 625 | 437 | 1 |

METHOD OF MANUFACTURING REFRIGERATED REPOSITORIES AND SALES MANAGEMENT SYSTEM FOR REFRIGERATED STORAGE

BACKGROUND OF THE INVENTION

1. Field of the Invention

The present invention relates to a method of manufacturing cooling storage units and a sales management system for the same.

2. Description of the Related Background Art

Refrigerated storage units for commercial use include, for instance, refrigerators, freezers, and freezer-refrigerators with integrated functions, have conventionally been manufactured and sold in the following described manner.

As shown in FIG. 15, a customer A, operating a restaurant or the like, would find the specifications of a refrigeration unit in a catalog or a similar information providing type of material, and submit an inquiry to a sales representative B of a dealer firm. The sales representative B then contacts the production management department C in the factory in order to determine the expected delivery date, price, and other aspects of the product. After final sales negotiations with customer A and acceptance of the terms and conditions, customer A places a formal order with the dealer firm.

The cooling storage unit basically consists of a thermally insulated box and a refrigerating device for cooling the interior. There are many types of thermally insulated boxes. The various boxes differ in cooling applications, i.e., from refrigerating to freezing, in shape and orientation, such as vertical and lateral (horizontal), in the number of doors, in storage capacity, and other respects. However, since the refrigerating device has to typically be customized to match the refrigerating capability and the storage capacity of the respective thermally insulated boxes, custom refrigerating devices are required as diverse as the thermally insulated boxes. It would be prohibitively difficult to design and produce all such potential refrigerating devices in advance and keep them in stock. Instead, the refrigerating devices are only generally made to order. The primary exceptions to this practice would be the standard models that are usually sold in large amounts. Consequently, conventional methods impose constraints with regard to short-term delivery times and cost reductions. Moreover, the fact that a thermally insulated box and a refrigerating device have to be newly designed, fabricated and assembled, into a cooling storage unit for every individual order creates the need to perform individual cooling tests for every unit prior to shipping. The cooling tests are required to make ensure that each cooling storage unit has a refrigerating capability as designed. However, the cooling tests result in a further delay of delivery.

One solution, as disclosed in Patent Reference 1, is a thermally insulated box designed to have a knockdown configuration so as to be assembled at the installation site of the cooling storage unit and thereby reduce some of the overall transportation costs. However, even with such a knockdown configuration, a refrigerating device matching a thermally insulated box would have to be designed for every individual refrigeration unit ordered and without exception, put through cooling tests once the refrigerating device is fitted to the thermally insulated box (typically at the installation site) Therefore, the knockdown approach cannot significantly contribute to speeding delivery and/or reducing costs.

Patent Reference 1: Japanese Patent Application Laid-Open No. 6-347159

An object of the present invention, determined in view of the circumstances noted above, is to provide a method of manufacturing cooling storage units, and a sales management system for the same, which can exclude the problems of a made-to-order production system which indispensably requires delay inducing pre-shipment cooling tests as described above.

SUMMARY OF THE INVENTION

In order to achieve the object stated above using a method of manufacturing cooling storage units according to a first aspect of the present invention, a thermally insulated box is selected from a group of thermally insulated boxes of predetermined various sizes of specifications. A cooling unit is manufactured to be able to operate at a prescribed cooling capacity in any one of the group of thermally insulated boxes. The selected thermally insulated box and the cooling unit are transported to the installation site of the cooling storage unit. The thermally insulated box and the cooling unit are combined into the cooling storage unit at the installation site.

A method according to a second aspect of the invention is a variation of the method according to the first aspect. The cooling unit is assembled by connecting a compressor, a condenser, an expansion mechanism, and an evaporator, into a circuit via refrigerant piping. The expansion mechanism has an intermediary characteristic between what is suitable for refrigerating use and what is suitable for freezing use.

By a method according to a third aspect of the invention, the expansion mechanism is composed of a capillary tube. The capillary tube has an intermediary characteristic flow rate between what is suitable for refrigerating use and what is suitable for freezing use. An accumulator is disposed on the outlet side of the evaporator. A heat exchanging section, capable of exchanging heat with refrigerant piping on the outlet side of the evaporator is disposed at the front half region of the capillary tube.

The capillary tube according to the invention is defined as a capillary tube having an intermediary characteristic flow rate between the flow rate suitable for a refrigerating purpose and the flow rate suitable for a freezing purpose. A capillary tube suitable for a refrigerating purpose in this context means having a flow rate characteristic such that when the cooling unit is operated at a normal temperature in combination with a thermally insulated box, the internal equilibrium temperature (the temperature at which the freezing capacity of the cooling unit and the thermal load on the thermally insulated box are balanced) is about 0 to −10° C. A capillary tube suitable for a freezing purpose means having a flow rate characteristic such that the internal equilibrium temperature is about −15 to −25° C. Therefore, it is preferable for the capillary tube to have an intermediary characteristic flow rate between the flow rate characteristics for a refrigerating purpose and a freezing purpose. According to the invention, the capillary tube should have an intermediary characteristic flow rate wherein the internal equilibrium temperature is about −10 to −20° C. when the cooling unit is operated under the same conditions (i.e., when the cooling unit is operated at a normal temperature in combination with a thermally insulated box).

A method according to a fourth aspect of the invention is a version of the method according to the second or third aspects of the invention. The compressor is a variable-capacity compressor. The cooling unit is provided with memory means in which pull-down cooling characteristics indicate the mode of variation over time of a temperature drop (the change in temperature versus the change in time, referred to as the target extent of internal temperature reduction). The memory means may store the target extent of internal temperature reduction for the pull-down cooling region, which is the temperature region extending from a high temperature well above a set temperature which is the cooling target temperature within the thermally insulated box, to the temperature region leading to the vicinities of the set temperature which is stored as data. The operation control means, on the basis of the output of a temperature sensor used to detect the internal temperature of the thermally insulated box, varies the capacity of the compressor so that the internal temperature falls while substantially following the pull-down cooling characteristics read out of the memory means.

A method according to a fifth aspect of the invention is a version of the method according to any of the second through fourth aspects of this invention. The compressor is a variable-capacity compressor, and the cooling unit is set so as to perform controlled cooling. In controlled cooling the alternation of the operation of the compressor occurs when the internal temperature in the thermally insulated box reaches an upper temperature limit, higher by a prescribed degree than a predetermined set temperature. The compressor is stopped from operating when the internal temperature has reached a lower temperature limit below the set temperature by a prescribed degree. The cycle is repeated to maintain the inside of the box at substantially the set temperature. The compressor is provided with memory means in which controlled cooling characteristics indicating the mode of variation over time of a temperature drop, constituting the target extent of internal temperature reduction in the controlled cooling region, and upper and lower temperature limits, are stored as data. An operation control means is provided which, on the basis of the output of a temperature sensor used for detecting the internal temperature of the thermally insulated box, varies the capacity of the compressor so that the internal temperature fall follows the controlled cooling characteristics read out of the memory means.

A method according to a sixth aspect of the invention is a version of the method according to any of the second through fifth aspects wherein the cooling units can be subjected to individual operation control on the basis of a plurality of cooling requirement programs differing from each other in internal cooling temperature. The operation control has determining means for determining the cooling requirements of the matched thermally insulated box to which the cooling unit is to be fitted, and selecting means for selecting a desired program. On the basis of a determination signal from this determining means and the program matching the cooling requirements determined by the selecting means, the operation control makes the program executable.

According to a seventh aspect of the invention, there is provided a sales management system for selling to customers cooling storage units, each composed by combining a thermally insulated box with a cooling unit. The cooling storage units are provided with required specification input means for entering, on the basis of an order by any of the customers, specifications required by the customer. The specifications may include the shape, the purpose from among refrigeration, freezing, and combined refrigeration-freezing purposes, and the storage capacity of the cooling storage unit. A received order database is also provided for storing the required specifications entered by the required specification input means, and information on the customer having ordered it, both matched with an order identification variable. A thermally insulated box database is used for storing the shapes, the purpose from among refrigeration, freezing, and combined refrigeration-freezing purposes, the storage capacities, and the required number of cooling units with respect to a plurality of thermally insulating boxes, all matched with the box ID of the respective thermally insulated boxes. A thermally insulated box searching means is provided for searching, with respect to each order identified by the order identification sign, the thermally insulated box database on the basis of the required specifications and determining the required thermally insulated box and the number of matching cooling units required by the customer. Shipping instruction means are used for communicating the thermally insulated box selected by the thermally insulated box searching means and the number of matching cooling units to their respective supply sources, together with customer information recorded in the order database.

[First Aspect of the Invention]

Since a cooling unit according to the invention is designed to be able to provide the prescribed cooling capacity in any one of a group of predetermined thermally insulated boxes, the cooling units can go through a cooling test by being fitted to a thermally insulated box maintained for testing use, without having to be fitted to the actual thermally insulated box with which the cooling unit is to ultimately be combined. As a result, the thermally insulated box and the corresponding cooling unit of the cooling storage unit can be separately fabricated, transported to the installation site, and combined to complete the cooling storage unit at the installation site. This makes it possible for the thermally insulated box and the cooling unit to be fabricated at different factory locations. For instance, thermally insulated boxes, which are large and very expensive to transport, can be manufactured in a locality where there are many customers nearby. Cooling units, which are less costly to transport, can be fabricated in a locality where labor costs are lower.

Also, if a cooling storage unit is configured from a combination of a cooling unit and a thermally insulated box, the configuration will permit a sales system in which thermally insulated boxes are selected from a predetermined group of thermally insulated boxes of different sets of specifications manufactured at one factory. Cooling units, each capable of implementing the prescribed cooling capacity for any one of the group of thermally insulated boxes, are fabricated at another factory. The thermally insulated boxes and the cooling units are individually transported to the installation site of the cooling storage unit. The thermally insulated box and the cooling unit are initially assembled at the installation site. This process can help to substantially shorten the lead time as compared with a conventional made-to-order sales system.

This system also allows a sales system where the cooling units are stocked at the offices of the sales company (or the sales department). Upon receipt of an order by a customer for a cooling storage unit, the cooling unit only has to be transported to the installation site from the sales office. The thermally insulated box, meeting the requirements of the customer, can be directly shipped to the installation site from the factory.

[Second Aspect of the Invention]

Adaptation to the low-flow rate freezing region is made possible by using an expansion mechanism of the intermediary characteristic flow rate between the flow rate characteristics for refrigerating and freezing purposes. A throttling effect is achieved by disposing an accumulator on the outlet side of the evaporator. The cooling unit is thereby enabled to commonly serve the two purposes.

[Third Aspect of the Invention]

Adaptation to the high-flow rate freezing region is made possible by using a capillary tube as the expansion mechanism and, moreover, placing the heat exchanging section in the front half region of the capillary tube. The location of the heat exchanging section thereby allows a reduction in the total resistance in the tube. Accordingly, the cooling unit is able to be commonly used while using the capillary tube as the expansion mechanism.

[Fourth Aspect of the Invention]

Traditionally, for a commercial use refrigerator (or similarly, for a commercial freezer or a freezer-refrigerator), the temperature characteristics during pull-down cooling is of particular importance. Cooling from a high internal temperature, such as 20° C. or more, only occurs in a few situations in addition to the start-up operation after installation. High internal temperature cooling periods may occur when restarting the refrigerator after a few hours while the power is cut-off for maintenance or other purposes, keeping the door open for a few minutes when bringing in food to be stored, or putting in hot food, in addition others. However, typical day-to-day operation may result in the situation where the door of a commercial refrigerator is frequently opened and closed in order to put food in or out. Since the ambient temperature surrounding the exterior of the cooling unit is relatively high, the internal temperature is apt to rise. Consequently, full consideration should be given to the temperature lowering performance of the cooling unit in order to ensure a quick return from such a higher temperature state.

For this reason, a performance test at the time of pull-down cooling is indispensable. According to the invention, pull-down cooling characteristics indicating the mode of variation over time (the change of temperature versus the change in time) of a temperature drop constituting the target extent of internal temperature reduction in pull-down cooling region, are stored as data in the memory means. The capacity of the compressor is so varied that the internal temperature drops while following the stored pull-down cooling characteristics.

In other words, irrespective of the conditions of the thermally insulated box to be mounted to the cooling unit, pull-down cooling is performed in accordance with the stored prescribed pull-down cooling characteristics. Therefore, the performance test for pull-down cooling can be performed for example, by using a thermally insulated box designed specifically for testing use. The specific conditions of the actual thermally insulated box, to which the cooling unit is to be fitted at the insulation site, are not required for a successful pull-down cooling test. This results in an increased freedom with respect to the place and time of the performance test.

[Fifth Aspect of the Invention]

When the compressor is being operated in controlled cooling, its capacity is controlled so that the internal temperature falls by following previously stored controlled cooling characteristics. By setting the controlled cooling characteristics on an easy decreasing slope, it is possible to accomplish cooling while operating the compressor at a relatively low power level, i.e. saving overall energy consumption.

Conversely, by setting the controlled cooling characteristics to appropriately reach a lower temperature limit, the operation of the compressor can be reliably stopped. This setting would enable the evaporator to accomplish a kind of defrosting and to prevent heavy accumulation or buildup of frost.

[Sixth Aspect of the Invention]

While the cooling unit is made adaptable to a plurality of cooling specifications, differing from one another in internal cooling temperatures, all the operation programs for the different cooling specifications are stored in the control means. When the cooling unit is fitted to the thermally insulated box, determining means determines the cooling specification of the thermally insulated box. The control means selects the appropriate operation program in accordance with the determination signal in order to execute the operation program.

Therefore, a common cooling unit including a control means can be adapted to various cooling storage units differing in cooling specifications. Moreover, the cooling unit can be accurately operated in accordance with a program matching the applicable cooling specification.

[Seventh Aspect of the Invention]

When an order for a cooling storage unit is placed by a customer, the requirements are entered into the required specification input means. A record is created in the received order database. The thermally insulated box database is searched for thermally insulted box matching the requirements of the customer. The required number of cooling units is determined for the thermally insulated box. The system then automatically informs the respective supply sources of the thermally insulated box and the number of appropriate cooling units.

BRIEF DESCRIPTION OF THE DRAWINGS

FIG. 2 is a table showing the data structure of a thermally insulated box database;

FIG. 3 is a table showing the data structure of a received order database;

DETAILED DESCRIPTION OF THE PREFERRED EMBODIMENT

A preferred embodiment of the present invention will be described below with reference to FIG. 1 through FIG. 14.

A cooling storage unit, whose structure will be later described in detail, is presupposed in the description of a method of manufacturing and a sales management system 100 of this embodiment. The cooling storage unit is assembled by fitting a cooling unit to a body consisting of a thermally insulated box. The body is selected by the customer from a group of bodies (i.e., thermally insulated boxes) conforming to a variety of predetermined specifications. The cooling unit is a common item designed and fabricated to be able to provide the required cooling capacity for any one of the group of bodies. The individual elements specified for the group of bodies may include the cooling requirement for the freezing, refrigerating, or combined freezing/refrigerating purposes; the orientation or shape of the body, such as vertical and lateral (horizontal); the number of doors, the width, the length, the depth; the storage capacity; and other aspects. Refrigerated storage units of various types, differing in these respects, may be listed in a printed catalog or on an Internet web site for the purpose of generating sales.

Figure 1:
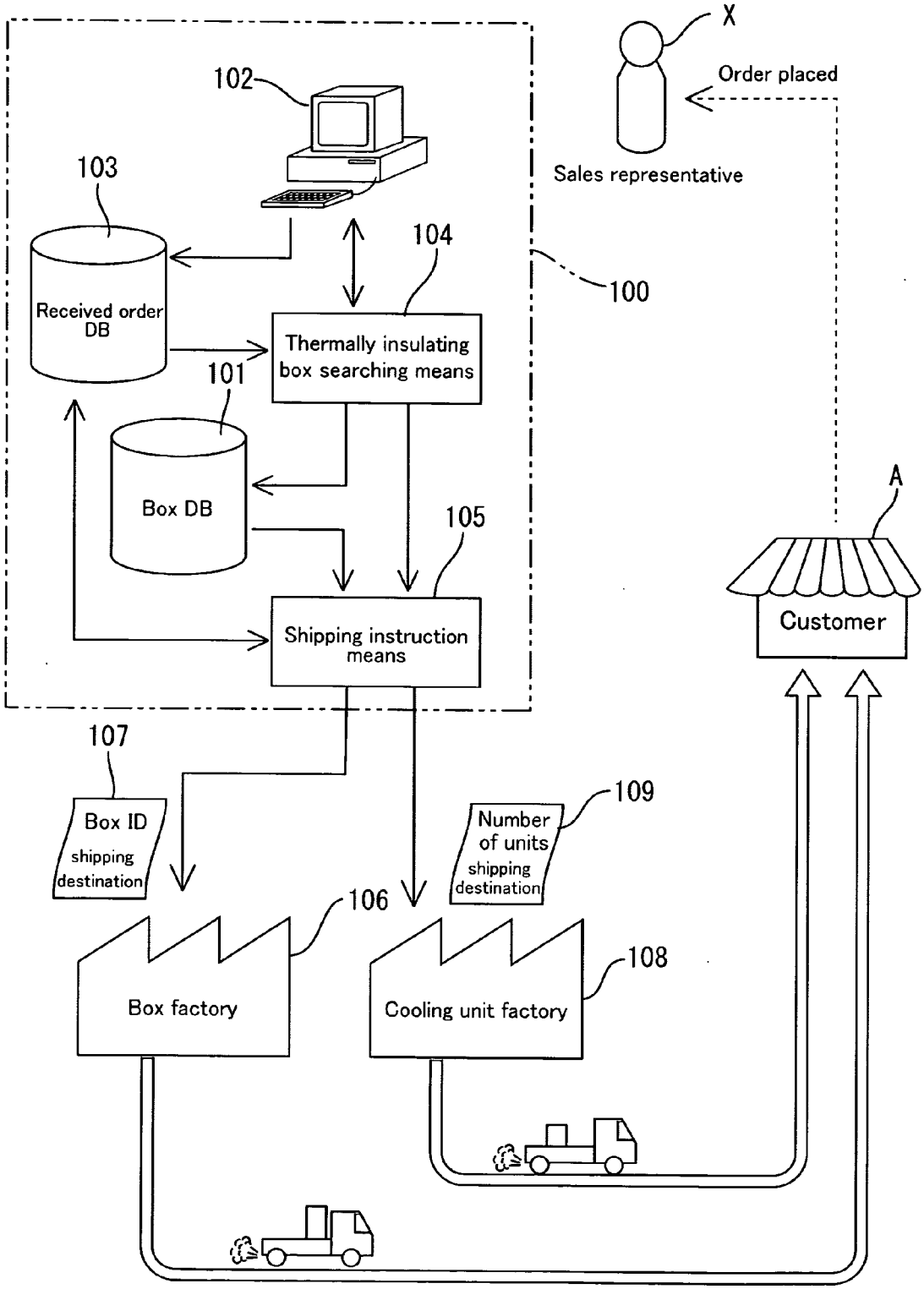
FIG. 1 is an overall block diagram of a preferred embodiment of the sales system of the present invention.

The sales management system 100 of this embodiment, as shown in FIG. 1, is provided with a thermally insulated box database (hereinafter abbreviated to "box DB") 101. This box DB 101 stores the specifications of the various thermally insulated boxes and the required number of cooling units for each of the various thermally insulated boxes. An example of the data structure and the types of data contained within the structure of box DB 101 is listed in FIG. 2. One box DB 101 record is created for each type of body (thermally insulated box). In this embodiment, each record has fields of "box ID", "cooling requirement", "vertical or lateral", "number of doors", "type of door", "width", "length", "effective capacity", and "number of required cooling units". The "box ID" is the unique identifier for a specific thermally insulated box. The "cooling requirement" may be freezing, refrigeration, or combined freezing/refrigeration. "Vertical or lateral" indicates whether the longest dimension of a thermally insulated box is either vertical or horizontal (i.e., a table type unit). The "number of doors" simply specifies the number of doors accessing the interior of the cooling storage unit. The "type of door" refers to whether the door is made of stainless steel and opaque or of framed glass and therefore transparent. The "width", is the maximum external width of the thermally insulated box. The "length" is the maximal length of thermally insulated box. And the "effective capacity" is the available storage capacity of thermally insulated box. The "number of required cooling units" field indicates the number of cooling units required in order to meet the stated "cooling requirement" of the thermally insulated box.

An example of a sale will now be described in detail. When a customer A wishes to buy a cooling storage unit, which may be a refrigerator, a freezer, or a combination thereof, customer A may either consult with a sales representative X of a dealer firm, reference a catalog or the like, or search an Internet web site. Customer A uses these resources to determine the specification of a cooling storage unit that will meet customer A's individual requirements. The sales representative X enters the specification information required by customer A along with any additional customer information into an order processing computer 102, which corresponds to a required specification input means. When the information is entered into the order processing computer 102, a record is added to a received order database 103 (herein after referred to as "received order DB" 103). For every order received, a record, with the data structure shown in FIG. 3 for example, is added. A unique "received order ID" is set identifying an individual received order. Items of customer information, for example the "customer's name" and the "shipping destination", may be recorded along with the "responsible sales representative" for a particular received order. Additionally, the specifications previously determined by customer A are entered into the appropriate fields of "cooling requirement", "vertical or lateral", "number of doors", "type of door", "width", "effective capacity", etc.

The thermally insulated box searching means 104 is composed of software executed by a CPU (not shown) in the sales management system 100. Execution of a search by the sales representative X, via the order processing computer 102, causes the thermally insulated box searching means 104 to search for a specific thermally insulated box meeting the inputted specification information of a pertinent "received order ID". The "box ID" of that thermally insulated box, together with the "required number of cooling units" and the value of the "received order ID," is then transferred to the shipping instruction means 105.

Referring to "received order ID" "3111303" for instance (see FIG. 3), the required specification consists of: "cooling requirement"=freezing/refrigeration, "vertical or lateral"=vertical, "number of doors"=2, "type of door"=stainless steel, "width"=625 mm and "effective capacity"=437 L. Therefore, since the "box ID" matching the required specification of this received order ID is found to be "RF0002" from the contents of the box DB 101, the values of a "box ID"="RF0002", "required number of cooling units"="2", and a "received order ID"="3111303", are deliver to the shipping instruction means 105. If no thermally insulated box matching the required specification is found, the absence is indicated on a display unit to urge re-inputting of new specifications. The matching process may also contain limits in place of equality. For example, the customer may wish to order a unit with a minimum "effective capacity" of 437L and a maximum "width" of 625 mm.

The shipping instruction means 105 then accesses the received order DB 103 and acquires the "customer's name", "shipping destination", and "number of units ordered", along with the "received order ID" as the key. Based upon this information, the shipping instruction means 105 transmits a shipping slip 107 recording the "box ID", "customer's name", "shipping destination", and the number of units to be shipped (which corresponds to the "number of units ordered") to a box factory 106 which fabricates the thermally insulated boxes. At the same time, a shipping slip 109 recording the "customer's name", "shipping destination", and the number of units to be shipped (corresponding to the "number of units ordered" multiplied by the "required number of cooling units" per unit) is transmitted to a cooling unit factory 108 which fabricates the cooling units.

As a result, in accordance with the shipping slip 107, only as many thermally insulated box or boxes matching the "box ID" as indicated by the designated number of units to be shipped are shipped from the box factory 106 to the customer A. Independently of this and in accordance with the shipping slip 109, only as many cooling unit or units in stock as are indicated by the designated number of units to be shipped, are shipped from the cooling unit factory 108 to the customer A. At the customer A's installation site, the required number of cooling units are fitted to the thermally insulated boxes by the service personnel. The service personnel also set a predetermined program for operating the cooling units, in this case, a predetermine program for the freezer-refrigerator combination. Thereby a freezer-refrigerator is completed having the desired functions.

The cooling units fabricated at the cooling unit factory 108 have gone through a cooling test prior to leaving the cooling unit factory 108. The cooling units are fitted to a thermally insulated box designed for testing use (not necessarily of the same type as the thermally insulated box to which an individual cooling unit is to be eventually fitted) and operated in accordance with a prescribed cooling test program. It is thereby possible to confirm that the cooling unit operates normally and performs the prescribed cooling functions in accordance with a set program.

Consequently, if a refrigerator is fabricated in the manner of this embodiment, there is no need to subject the cooling unit to a completely new cooling test procedure after the cooling unit is fitted to thermally insulated box at the customer A's refrigerator installation site. Only a minimum cooling test is required to be performed in order to check the operation of the cooling unit. This results in a relatively simple process to complete the fitting task of the cooling units at the customer A's installation site.

Next, a freezer-refrigerator that embodies the invention will be described in detail. The freezer-refrigerator is fabricated by the method of manufacturing and sold under the sales management system as previously described.

Figure 4:
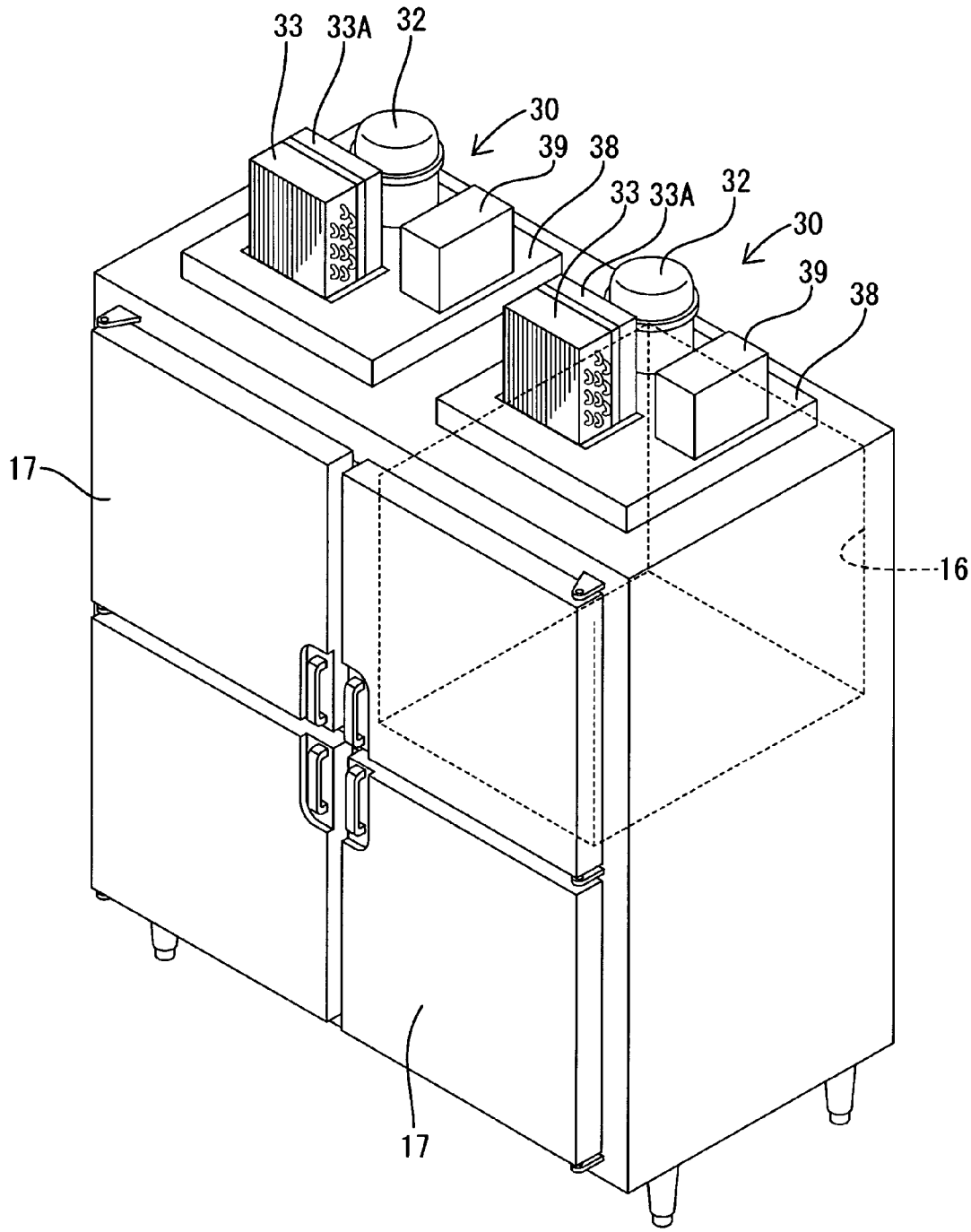
FIG. 4 shows a perspective view of a freezer-refrigerator unit, which is a preferred embodiment of the invention.
Figure 5:
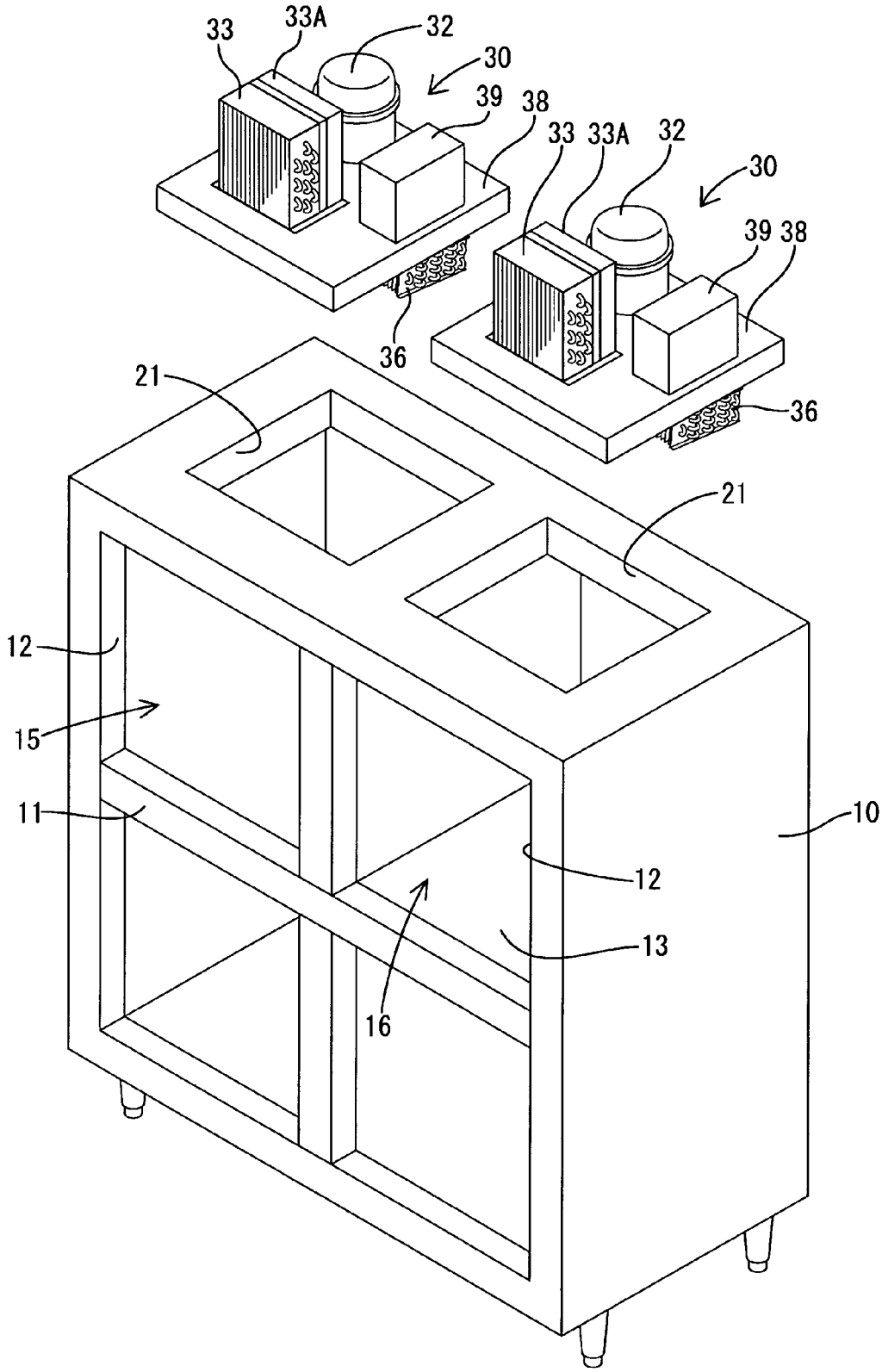
FIG. 5 shows an exploded perspective view of the unit in FIG. 4.

The freezer-refrigerator of this embodiment is a four-door type of freezer-refrigerator. As shown in FIG. 4 and FIG. 5, the freezer-refrigerator has a body 10 consisting of a thermally insulated box whose front (to the left in FIG. 5) face is open. A cross-shaped partitioning frame 11 divides this front opening into four inlet/outlets 12. About ¼ of the internal space, shown as the top right inlet/outlet 12 as viewed from the front side of the body 10 in FIGS. 4 and 5, is partitioned by a thermally insulated partitioning wall 13 so as to constitute a freezer compartment 16. The remaining approximately ¾ of the internal space of the body 10 is designed as a refrigerator compartment 15. Each of the inlet/outlets 12 is equipped with a thermally insulating door 17 that allows access to a portion of the internal space of the body 10.

On the top face of the body 10, a machinery compartment 20 is configured by erecting panels 19 (see FIG. 7) and otherwise to enclose a space. Rectangular openings 21, of the same size, are formed in the top face of the body 10. The openings 21 constitute the bottom of the machinery compartment 20. The openings 21 are respectively formed in the ceiling wall of the refrigerator compartment 15 and the ceiling wall of the freezer compartment 16. A cooling unit 30 is individually fitted into each of the openings 21.

Figure 6:
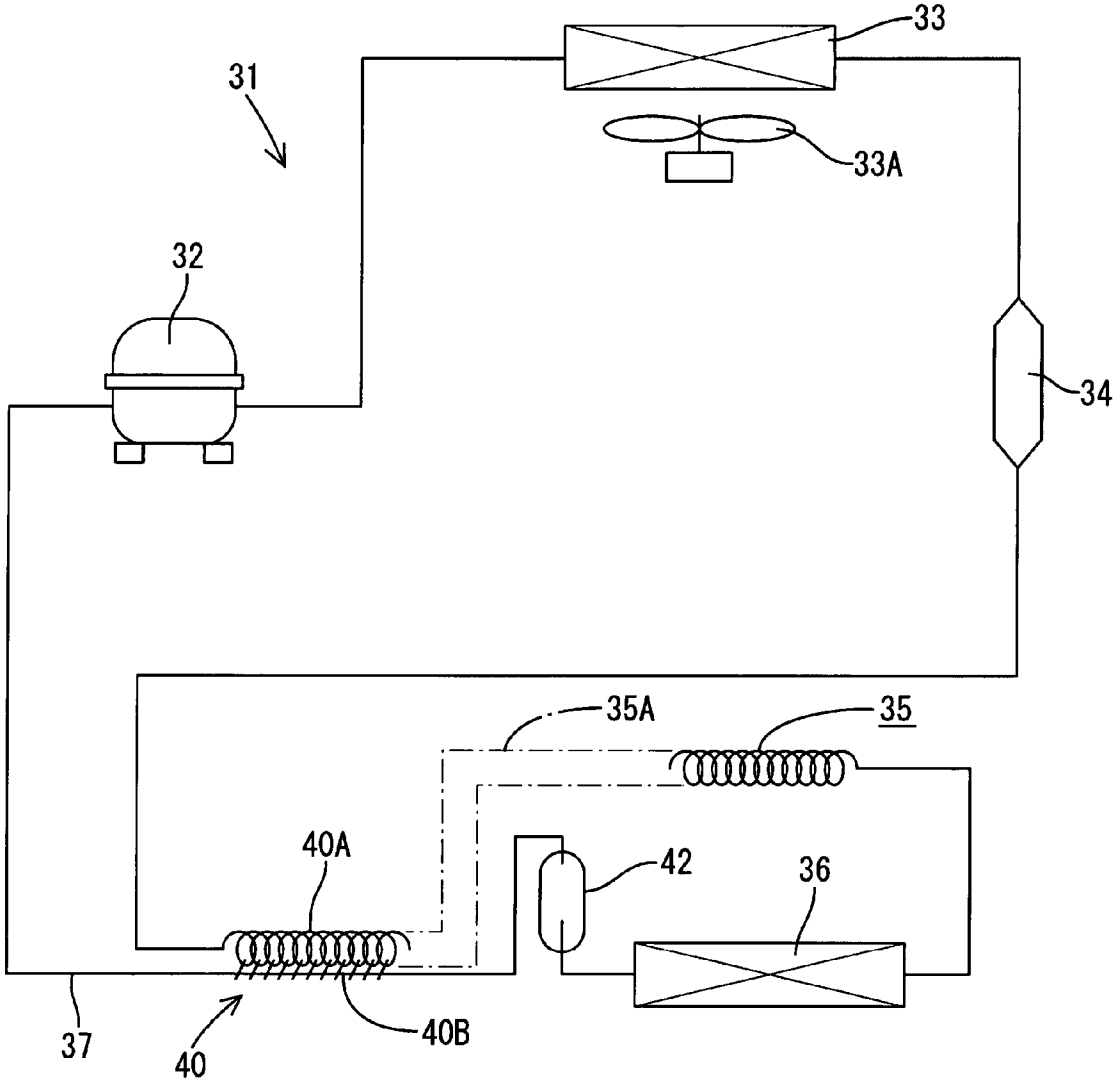
FIG. 6 is a diagram of a freezing circuit.

In the cooling unit 30, as will be described in detail afterwards, a freezing circuit 31 is configured by connecting a compressor 32, a condenser 33 with a condenser fan 33A, a dryer 34, a capillary tube 35 and an evaporator 36 by refrigerant piping 37 into a circuit as shown in FIG. 6. There is further disposed a thermally insulated unit base 38 mounted over the openings 21 to substantially thermally seal the interior of the refrigerator compartment 15 and the freezer compartment 16. The cooling unit 30 and the evaporator 36 are fitted under the unit base 38 (i.e., in the interior of body 10). The other components of the cooling unit 30 are fitted to the top of the unit base 38 (i.e., to the exterior of body 10).

Figure 7:
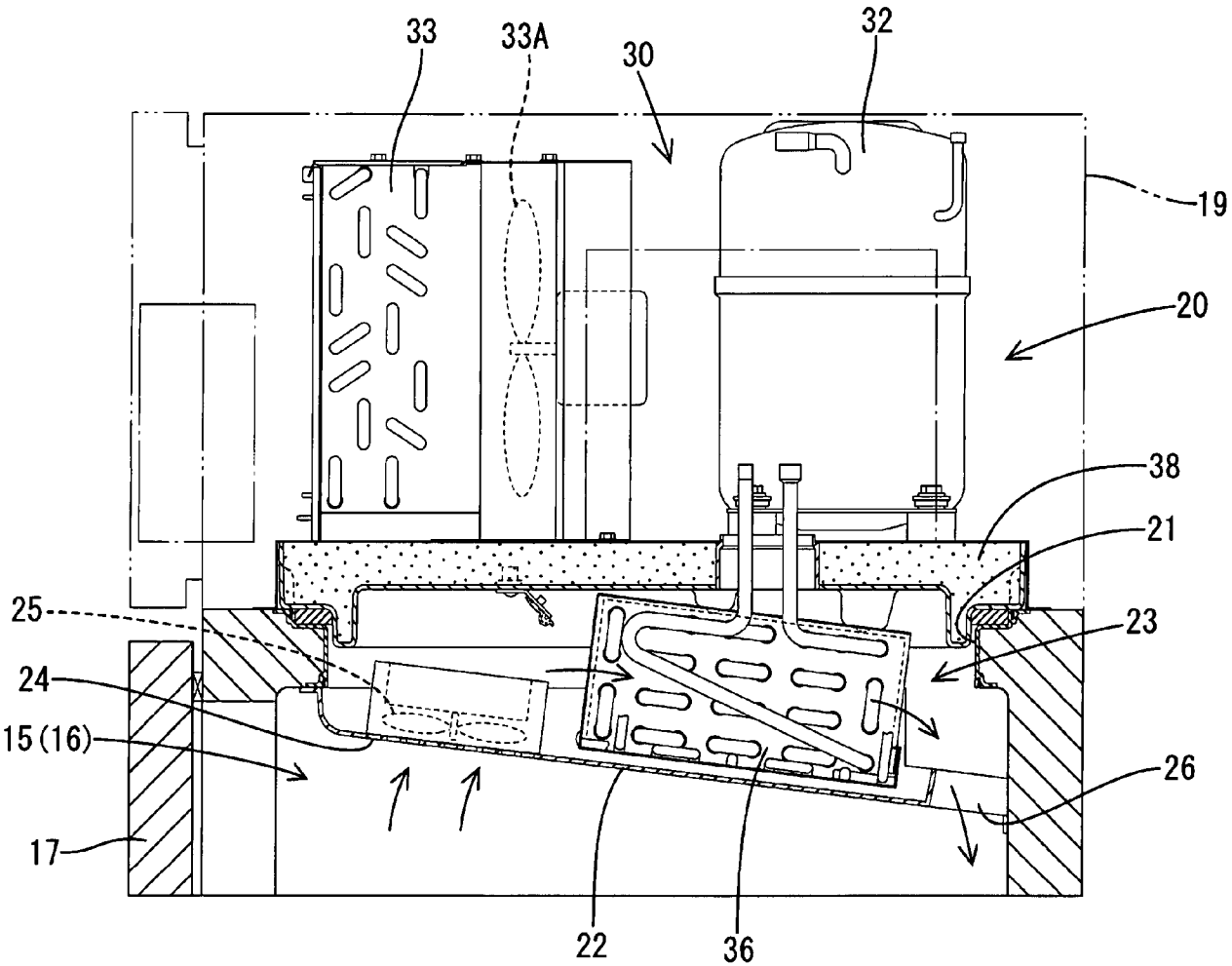
FIG. 7 shows a partial cross section of the upper portion of a cooling storage unit in which a cooling unit is installed.

In the ceiling portions of the refrigerator compartment 15 and the freezer compartment 16, a drain pan 22, which also serves as a cooling duct, is stretched with a downward inclination as shown in FIG. 7. The drain pan 22 enables the formation of an evaporator compartment 23 between the ceiling part and the unit base 38. A suction port 24, provided with a cooling fan 25, is disposed in the upper section of the drain pan 22. A discharge port 26 is disposed toward the lower end of the drain pan 22.

Essentially, when the cooling unit 30 and the cooling fan 25 are driven, air in the refrigerator compartment 15 (or the freezer compartment 16) is drawn through the suction port 24 into the evaporator compartment 23, as indicated by arrows in FIG. 7. Cool air is generated when the drawn air passes the evaporator 36 and is blown through the discharge port 26 into the refrigerator compartment 15 (the freezer compartment 16) in a cyclic process. The cooling cycle thereby cools the inside of the refrigerator compartment 15 (the freezer compartment 16).

In this embodiment of the invention, the cooling unit 30 is designed to be commonly used by different types of bodies (i.e., all the bodies stated in the box DB 103). In order to make the widespread applicability of the cooling unit 30 possible, the following measures are taken.

The cooling capacity of the cooling unit 30 is determined by the capacity of its compressor. If the capacity of a compressor is constant, the compressor can only cool a smaller volume on the freezing side, where the evaporation temperature is lower, as compared to the refrigeration size. In order to determine the capacity of a compressor for refrigerator compartments 15 or freezer compartments 16, greater volume compartments would necessarily require a greater cooling capacity compressor.

Consequently, the required cooling capacity of the compressor differs with variables such as the cooling requirement (refrigeration or freezing) and the relative size of the interior volume. To accommodate these variations, the compressor used in this embodiment is an inverter compressor 32. The inverter compressor 32 is compatible with the thermally insulated box having the greatest capacity (interior volume) among those contained within the box DB 101. In addition, the inverter compressor 32 has a controllable number of revolutions (i.e. the cooling capacity).

The capillary tube 35 is illustrated by the segment from the outlet of the dryer 34 to the inlet of the evaporator 36 in FIG. 6. A spiral part 35A of the capillary tube 35 is formed in the central portion to extend the overall length of the capillary tube 35. In this embodiment, the overall length of the capillary tube 35 is determined to be approximately in the range of 2000 mm to 2500 mm. Incidentally, the length of the refrigerant piping 37 from the outlet of the evaporator 36 to the suction port of the inverter compressor 32 is approximately 700 mm.

In selecting a capillary tube according to the prior art, priority is given to a high flow rate characteristic for refrigerating purposes and to a low flow rate characteristic for freezing purpose. The capillary tube 35 used in this embodiment has an intermediate characteristic flow rate between the flow rates conventionally selected for refrigerating and freezing purposes.

A capillary tube suitable for refrigerating purposes in this context means a capillary tube having a flow rate characteristic such that when the cooling unit is operated in combination with a thermally insulated box at a normal temperature, the internal equilibrium temperature (the temperature at which the freezing capacity of the cooling unit and the thermal load on the thermally insulated box are balanced) is approximately in the range of 0 to −10° C. A capillary tube suitable for freezing purposes is a capillary tube having such a flow rate characteristic that the internal equilibrium temperature is approximately in the range of −15 to −25° C. Therefore, a capillary tube 35, having an intermediary characteristic flow rate between the flow rates for refrigerating and freezing purposes, according to the invention is a capillary tube 35 wherein the internal equilibrium temperature is approximately within the range of −10 to −20° C. when the cooling unit is operated under the same conditions (i.e., in combination with a thermally insulated box at a normal temperature)

When a capillary tube 35 has an intermediary characteristic flow rate, there is a conventional concern that the flow rate of the liquid refrigerant may be in sufficient in the refrigerating region. However, this problem is addressed by the following means.

A freezing circuit of this embodiment functions in part due to a heat exchanging device 40 formed by soldering the refrigerant piping 37, on the outlet side of the evaporator 36, to a portion of the capillary tube 35. The heat exchanging device 40 enhances the general level of evaporation performance by helping to vaporize the misty liquid refrigerant which may be left unevaporated by the evaporator 36. In this embodiment of the invention, in forming a heat exchange device 40 between the capillary tube 35 and the refrigerant piping 37, the heat exchanging section 40A, on the side of the capillary tube 35, is set in a prescribed area at the upstream side end of the spiral part 35A. The position of the heat exchanging section 40A may be located closer to the inlet of the capillary tube 35 relative to the overall length of the tube.

Figure 8A:
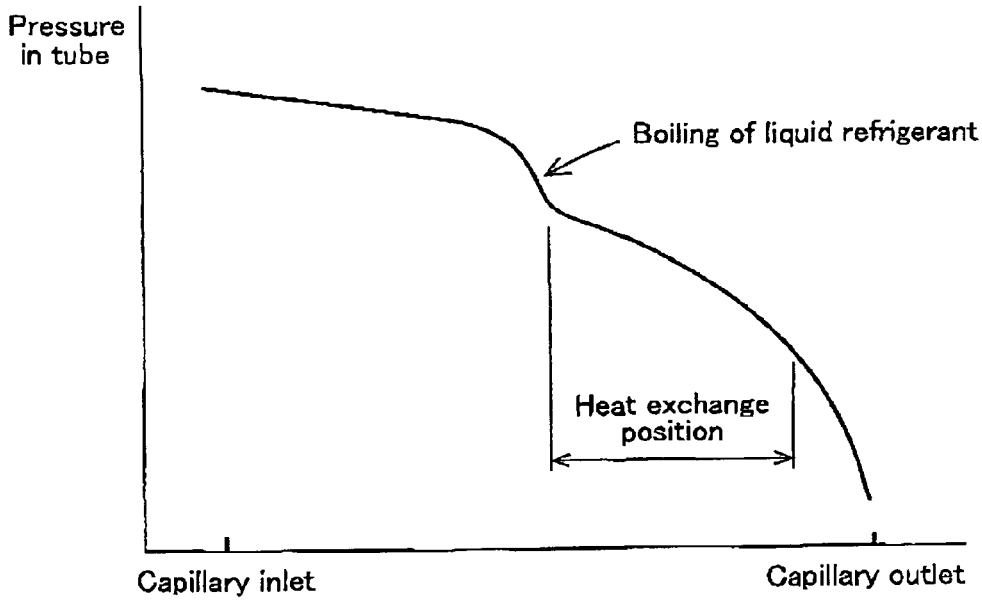
FIGS. 8(A) and 8(B) are graphs showing pressure variations in a capillary tube.

Whereas the capillary tube 35 has a large differential pressure between the inlet and the outlet, the flow resistance sharply rises in the portion where the liquid refrigerant began to boil (in approximately the central part of the overall length) as shown in FIG. 8A. The pressure drops significantly downstream (toward the outlet) from there. According to the prior art, the heat exchanging section of the capillary tube 35 is positioned in the latter half region of the overall length, closer to the outlet of the capillary tube 35. Consequently, a conventionally located heat exchanging device exchanges heat after the point of evaporation within the pipe (boiling) begins. This positioning is intended to have the heat exchanging take place as close to the output of the capillary tube 35 as practicable, as well as to minimize the length of the portion exposed in a cooled state. The downstream section of the capillary tube 35, from the heat exchange position, is prone to dew condensation and rusting.

Figure 8B:
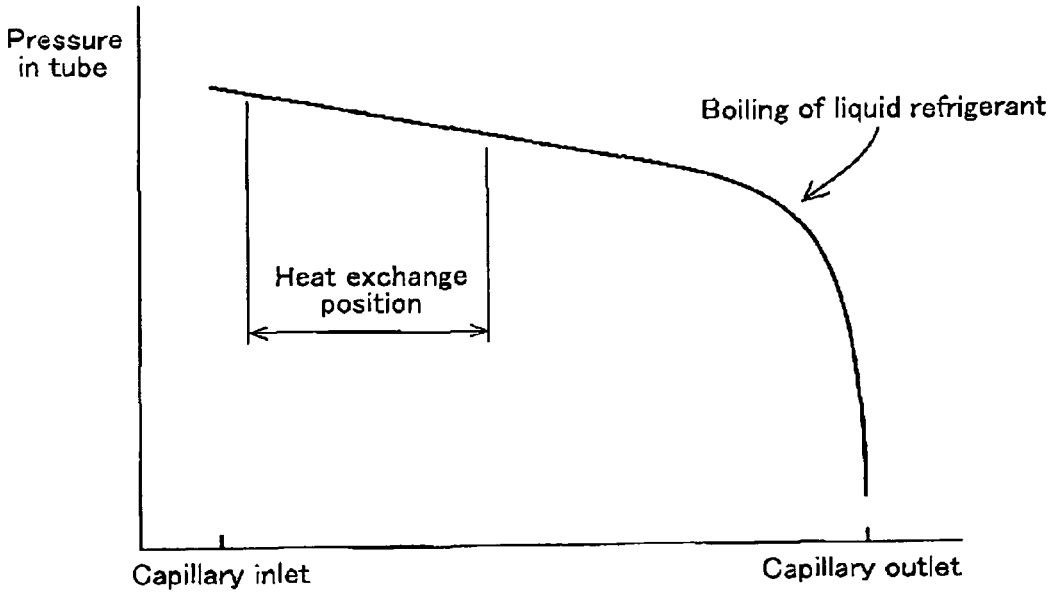

In contrast with this embodiment, since the heat exchanging section 40A of the capillary tube 35 is positioned closer to the inlet (i.e. upstream of the position where the liquid refrigerant begins to evaporate as stated above) and an ample allowance is made for overcooling, the point where boiling starts in the tube can be shifted farther downstream in the capillary tube 35, as shown in FIG. 8B. This embodiment results in a reduction in the total resistance of the capillary tube 35 and in an increase in the flow rate of the liquid refrigerant. This arrangement adequately addresses the problem of an insufficient flow rate that could occur when a capillary tube 35 having an intermediary characteristic flow rate is used in the refrigeration area.

Therefore, in order to achieve the advantages of shifting the boiling point to farther downstream in the capillary tube 35, the position of the heat exchanging section 40A of the capillary tube 35 can be located prior (upstream) to the position in which the liquid refrigerant begins to evaporate. The heat exchanging section 40A should be placed at least in the front half of the overall length of the capillary tube 35, and more preferably in the front ⅓ of the length of the capillary tube 35, toward the inlet (the area in which the liquid state of the refrigerant is dominant).

If the heat exchanging section 40A of the capillary tube 35 is positioned relatively closer to the inlet, a long section following this location will be exposed in a cooled state. Therefore, it is desirable for the long section to be placed as far as practicable from the refrigerant piping 37 and wrapped in a thermally insulating tube (not shown). These measures would aid in preventing dew condensation and rusting.

Conversely, the problem of insufficient throttling in a capillary tube 35 having an intermediary characteristic flow rate is addressed by disposing an accumulator 42 (liquid separator) immediately after the evaporator 36. The disposition of the accumulator 42 provides an adjusting capacity to accumulate the liquid refrigerant within the freezing circuit 31.

In the freezing region, as the refrigerant pressure in the evaporator 36 is lower (the evaporation temperature of the refrigerant is lower) and the density of the refrigerant gas is lower than in the pull-down region (the time region where the temperature is rapidly cooled) or the refrigerating region, the quantity of the circulated refrigerant provided by the compressor 32 is smaller. As a result, there is a surplus of the liquid refrigerant in the freezing circuit 31. However, as that surplus liquid refrigerant is accumulated in the accumulator 42, no superfluous liquid refrigerant will be circulated in the capillary tube 35 or elsewhere, and this effectively means a throttling of the flow rate in the capillary tube 35. The accumulator 42 can therefore resolve the problem of insufficient throttling, which may conventionally occur when a capillary tube 35 of an intermediary characteristic flow rate is used in the freezing region.

Consequently, in this embodiment which uses a capillary tube 35 of an intermediary characteristic flow rate, the accumulator 42 is disposed immediately after the outlet of the evaporator 36 in order to reduce the flow rate of the liquid refrigerant, i.e. to adapt to the low-flow rate freezing region. In addition, by setting the heat exchanging section 40A in the capillary tube 35 closer to the inlet in order to reduce the total resistance in the tube, the flow rate of the liquid refrigerant is increased, i.e. the high-flow rate pull-down region and the refrigerating region are adapted to each other.

Incidentally, when the accumulator 42 is to be provided, if it is positioned downstream of a heat exchanging section 40B of the refrigerant piping 37. The refrigerant may flow in a gas-liquid mixture state into the heat exchanging section 40B, and then the liquid refrigerant would evaporate. In other words, this means that the evaporation of the liquid refrigerant, which should have been accomplished by the evaporator 36, is done by the heat exchanging section 40B as an extra process, possibly leading to a drop in the overall cooling capacity of the freezing circuit 31.

In this respect, since in this embodiment the accumulator 42 is disposed immediately after the outlet of the evaporator 36, namely upstream of the heat exchanging section 40B in the refrigerant piping 37, only gaseous refrigerant flows to the heat exchanging section 40B and accordingly no extra evaporation occurs in the heat exchanging section 40B, making it possible to secure a sufficient overall cooling capacity for the freezing circuit 31.

Further, there may be concern that the setting of the heat exchanging section 40A in the capillary tube 35 closer to the inlet could invite an increase in the flow rate of the liquid refrigerant on the freezing side as well, but this fear is groundless for the following reasons.

The freezing circuit 31 equipped with the capillary tube 35 is basically configured in a form in which the refrigerant is shared between the high-pressure side and the low pressure side. Conceptually, the refrigerant is in the condenser 33 and then in the evaporator 36 while in the refrigerating region (including the pull-down region). While in the freezing region much of the refrigerant is in the evaporator 36 and the accumulator 42 and, conversely, only a small quantity of the refrigerant is in the condenser 33. Therefore in the refrigerating region the refrigerant flows into the capillary tube 35 as a fully liquid flow. While in the freezing region, the refrigerant flows as a gas-liquid mixture and accordingly the flow rate of the gas-liquid mixture is considerably reduced. Accordingly, even if the capillary tube 35 undergoes heat exchanging and is thereby overcooled at a position closer to the inlet, this will hardly cause an increase in the flow rate.

Conversely, there may be a concern that the presence of the accumulator 42 could cause a decrease in the flow rate in the refrigerating region (including the pull-down region) as well. However, there is a large circulating quantity of the refrigerant attributable to the compressor 32 in the refrigerating region (including the pull-down region) for reasons contrary to those stated above. This leaves only a little surplus of the liquid refrigerant in the freezing circuit 31 and a little to be accumulated in the accumulator 42. Accordingly there is almost no fear conceivable of a drop in flow rate.

As stated previously, while the cooling unit 30 is structurally commonly used for both the refrigerating and freezing purposes, the control operation of the cooling unit 30 is individually performed for the two different purposes. The reason for the individual control is based in part upon the perception that, while the cooling unit 30 may be used in common for the two purposes, the individual temperature characteristics in pull-down cooling, for example, may greatly vary depending on the purpose (i.e. refrigeration or freezing), or the relative size of the internal volume, among other variables.

Figure 9:
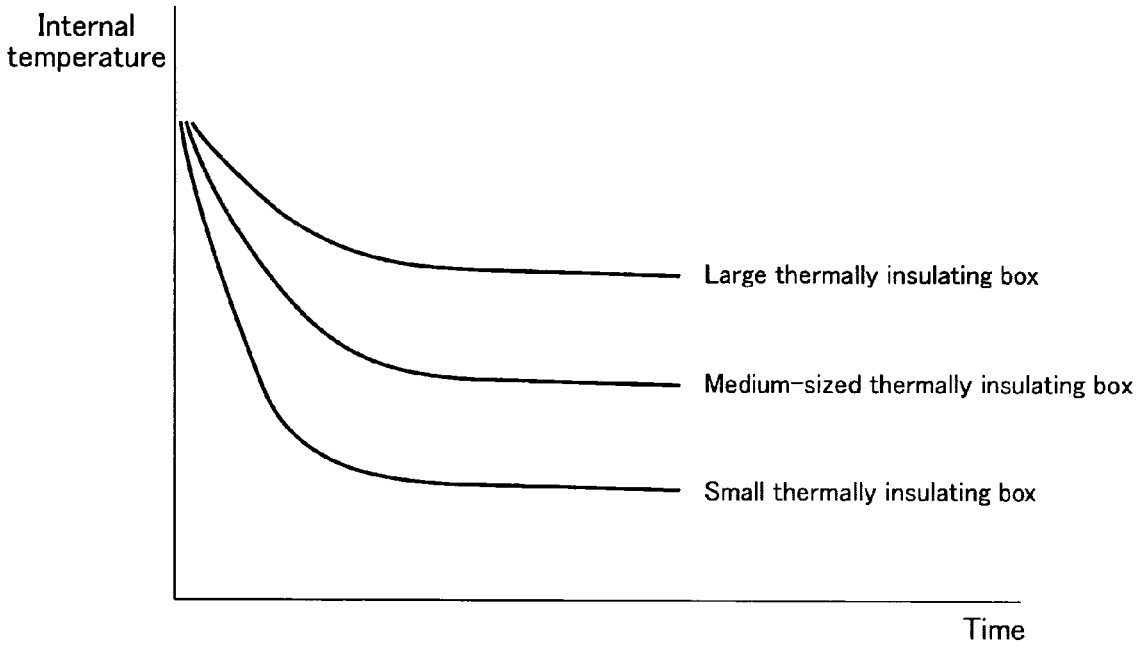
FIG. 9 is a graph of a temperature curve in a pull-down region.

The usual practice for a cooling unit mounted with an inverter compressor is to be operated at the maximum permissible speed when in pull-down cooling. However, the curve of the internal temperature response clearly differs, as shown in FIG. 9, depending on whether the (internal volume of) thermally insulated box is large, medium-sized or small, when the pull-down cooling is performed with no food stored in the box and other conditions also being the same. The extent of the temperature drop is proportional to the surface area of thermally insulated box (the temperature difference between the inside and the outside of the box being equal) for the reason that the bigger the box, the greater thermal capacities of the inner material and the shelf nets within the box.

For a refrigerator designed for commercial use (similarly for a freezer or a freezer-refrigerator), the temperature characteristics in pull-down cooling are of particular importance. Cooling from a high internal temperature, such as 20° C., usually occurs only when restarting after a few hours of a power cut-off for maintenance or other purposes, keeping the door open for a few minutes when bringing in large amounts of food to be stored, or putting in hot food, in addition to the start-up operation after installation. However, in view of the circumstances that require the doors of a commercial refrigerator to be frequently opened in order to put food in or take food out, and that the surrounding external ambient temperatures (e.g., for refrigerators placed in a restaurant kitchen for example) are relatively high, the internal temperature of the refrigerator is apt to greatly rise. Consequently, full consideration should be given to the temperature lowering performance of the cooling unit 30 in order to ensure a quick drop from such a higher temperature state.

For at least this reason, a performance test for the time of pull-down cooling is indispensable. This performance test should be conducted with the cooling unit mounted to the specific thermally insulated box ordered because the cooling speed is heavily dependent on the characteristics of the thermally insulated box, as described above. This requirement creates a problem that, even though the cooling unit is used in common, the delay causing pull-down cooling performance test remains as an issue.

In view of this problem, this embodiment uses means of controlling the temperature inside the box along a prescribed temperature curve, without depending on actual thermally insulated box, at the time of pull-down cooling.

Figure 10:
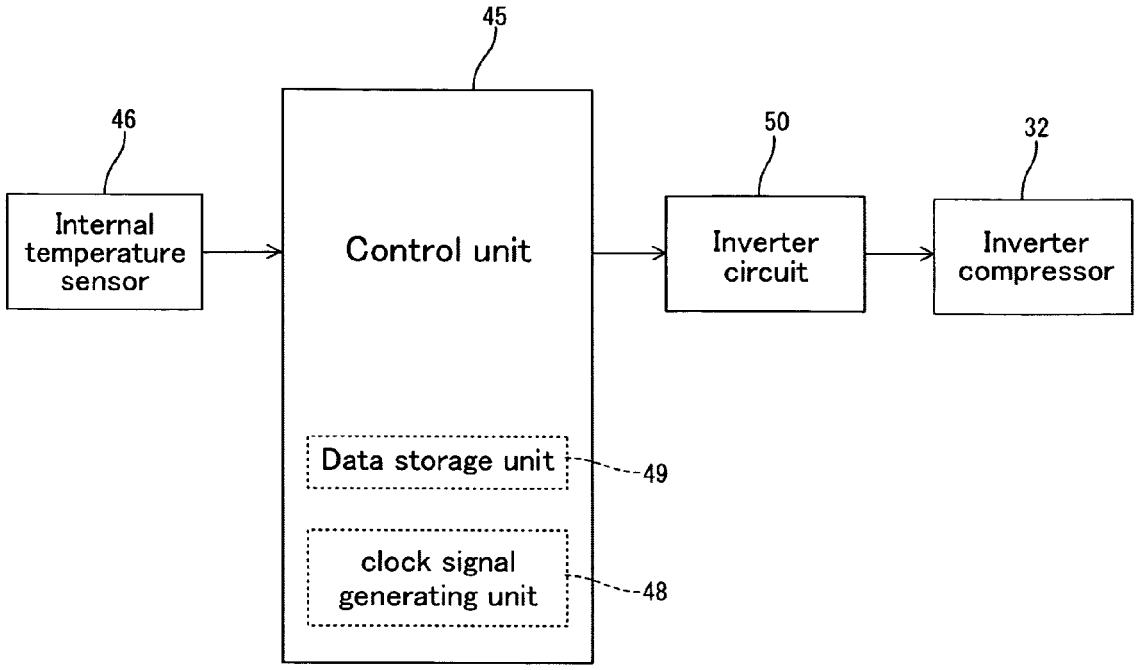
FIG. 10 is a block diagram of the control mechanism section of an inverter compressor.

To describe an example of this means, as shown in FIG. 10, there is provided a control unit 45 equipped with a microcomputer or the like to execute a prescribed program. The control unit 45 is housed in an electrical equipment box 39 (see FIGS. 4 and 5) disposed on the top face of the unit base 38, mounted with the cooling unit 30 as described above. An internal temperature sensor 46, for detecting the temperature inside of the box, is connected to the input side of the control unit 45.

Figure 11:
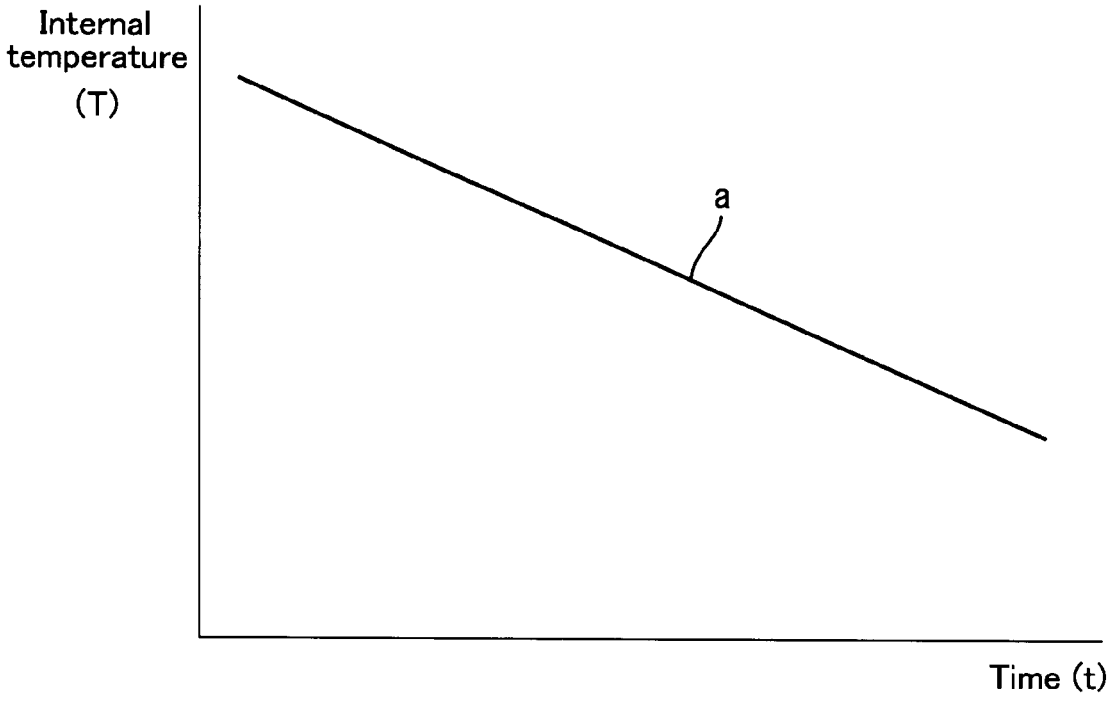
FIG. 11 is a graph of the ideal temperature curve during the time of pull-down refrigeration.

The control unit 45 is provided with a data storage unit 49 along with a clock signal generating unit 48. The straight line a of a linear function is selected as an ideal temperature curve in pull-down cooling, as shown in FIG. 11. This ideal temperature curve is stored in data storage unit 49. Where the ideal curve is a straight line a, as in this case, the target extent of internal temperature reduction (temperature variation per unit length of time: $\Delta T/\Delta t$) can assume a constant value A, independent of the actual internal temperature.

The inverter compressor 32 is connected to the output side of the control unit 45 via an inverter circuit 50.

The operation is described as follows. When the actual internal temperature has surpassed (i.e., higher than) the set internal temperature by at least a prescribed degree, pull-down control is initiated. The actual internal temperature is subsequently detected at prescribed intervals of time.

Figure 12:
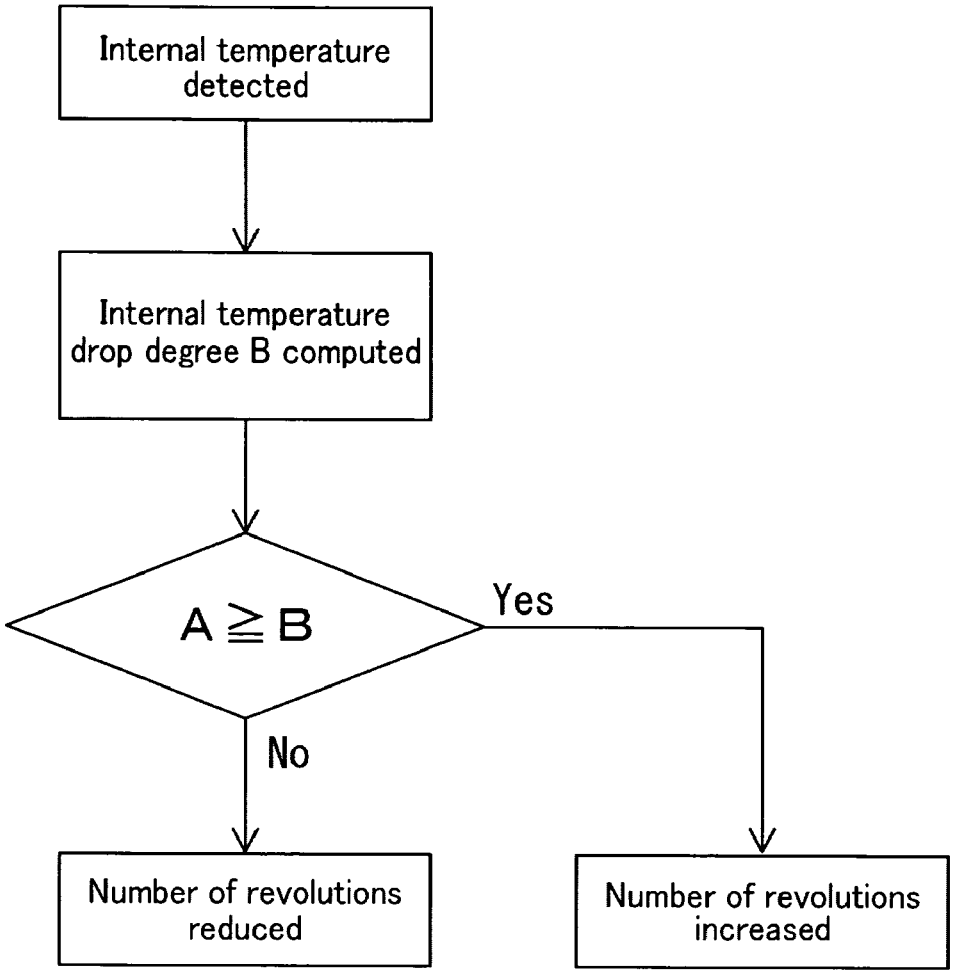
FIG. 12 is a flow chart of the control operation of the inverter compressor.
Figure 13:
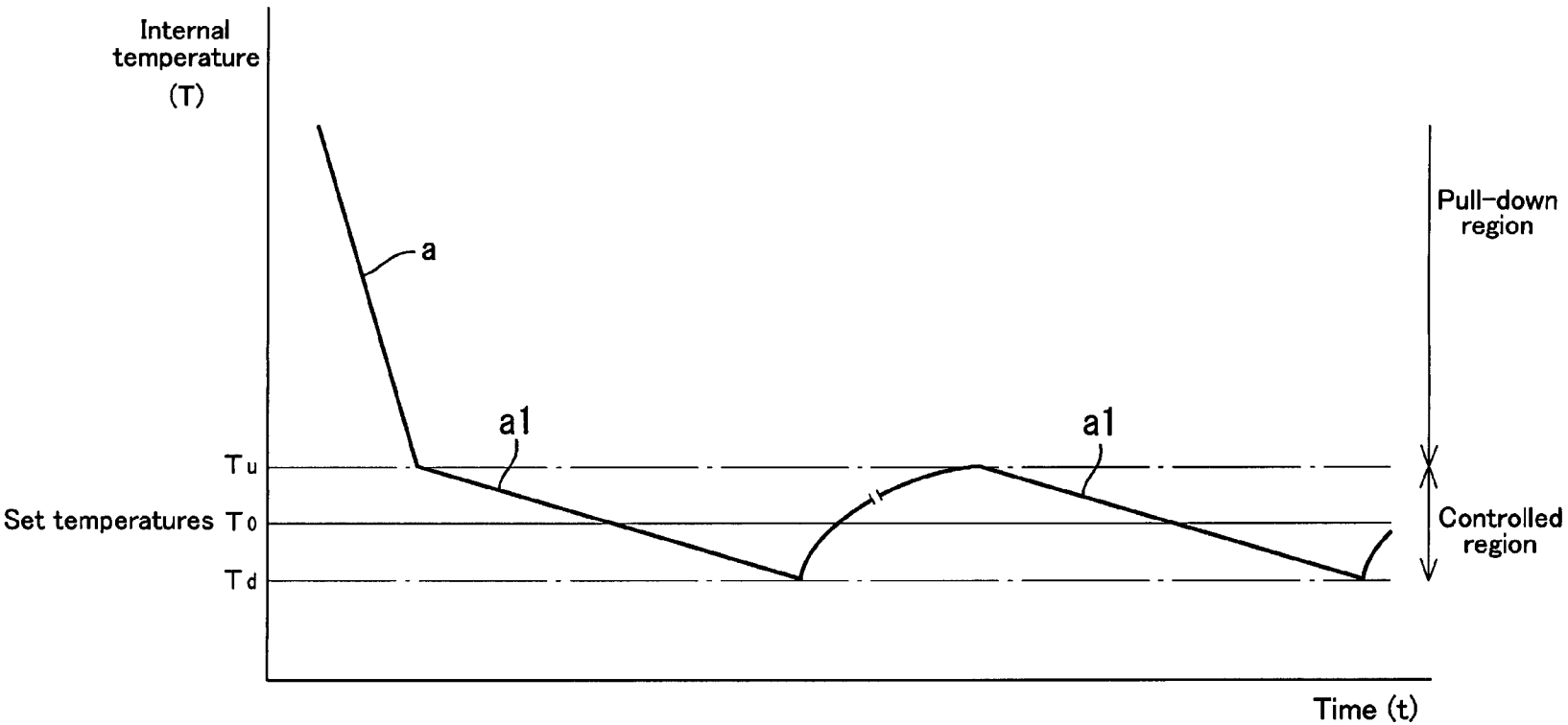
FIG. 13 is a graph showing temperature variations in the controlled region.

As shown in FIG. 12, at every occurrence of the detection of the actual internal temperature, the actual drop B of the internal temperature is computed. The computed value B is compared with the target value A read from the data storage unit 49. If the computed value B is found to be below the target value A, the number of revolutions of the inverter compressor 32 will be increased via the inverter circuit 50. Conversely, if the computed value B is found to be greater than the target value A, the number of revolutions of the compressor 32 will be reduced. These actions are repeated at every prescribed time interval. Consequently, pull-down cooling is accomplished substantially along the ideal curve (the straight line a).

After the pull-down cooling described above, controlled cooling is executed by which the internal temperature is maintained within the vicinities of respectively preset temperatures for both refrigeration and freezing. The use of the inverter compressor 32 as stated above for this embodiment provides the following advantages. By executing a controlled cooling so as to reduce the speed (the number of revolutions) of the inverter compressor 32 stepwise in the vicinities of the set temperatures, the temperature can be lowered very gradually. The result is that the duration of the period of continuous operation of the compressor 32 can be made predominantly longer. In other words the frequency of turning on and off the inverter compressor 32 is significantly reduced. In addition, since the inverter compressor 32 is operated at relatively low revolutions, there are resulting contributions to efficiency and energy saving.

In the process described above, it is necessary to set the cooling capacity of the low speed operation of the inverter compressor 32 so as to surpass the conceivable standard thermal load. If the cooling capacity is less than the conceivable thermal load, the internal temperature will not fall to the set level, resulting in a prematurely thermally balanced state and a failure of the internal temperature to fall any further. Where the cooling unit 30 including the inverter compressor 32 is used in common for a variety of applications, as in this embodiment, the applicable thermal load should be assumed as the thermal load from the box into which the greatest quantity of heat would invade, from among all of the thermally insulated boxes in box DB 101.

In addition, a commercial refrigerator (or freezer) is designed with particular attention given to reducing fluctuations in internal temperature distribution with a view to storing food at a relatively constant temperature level. For this reason, a cooling fan 25 of a sufficiently large capacity is selected to enable the fan to adequately perform the air circulating function. However, this may result in a relatively large quantity of heat emitted from the cooling fan 25 motor. Moreover, if the thermal capacity of the stored food, the ambient temperature outside of the refrigerator, the frequency of doors opening and closing, and other factors are all adverse, the thermal load may sometimes prove much greater than anticipated. In spite of the low speed operation of the inverter compressor 32, the internal temperature may stop dropping before reaching its set level. Or, even if the internal temperature does fall, it may fall to only a slight degree or at a reduced rate, possibly inducing an abnormally extended duration of the operation of the compressor 32.

Conventional beliefs state that a refrigerator will not have problems if only the refrigerator can maintain a temperature very close to the set level. The conventional practices are due in part to the belief that it is not desirable for any refrigerator to continue to operate with long periods of running the inverter compressor 32. This is because, as long as the refrigerator is operating, the evaporator 36 is continues to keep on collecting frost due to the air invading from outside when the door 17 is opened and closed and also due to the water vapor from the stored food. Conversely, if the inverter compressor 32 is turned off at appropriate intervals, the evaporator 36 will rise in temperature to or above 0° C. and start defrosting. It is also preferable for a refrigerator to be turned off at appropriate intervals from the standpoint of maintaining the heat exchanging function of the evaporator 36.

In view of this aspect, this embodiment uses means of control by which the controlled cooling takes advantage of the use of the inverter compressor 32. The means of control function to achieve energy savings and further secure non-operating intervals.

Figure 14:
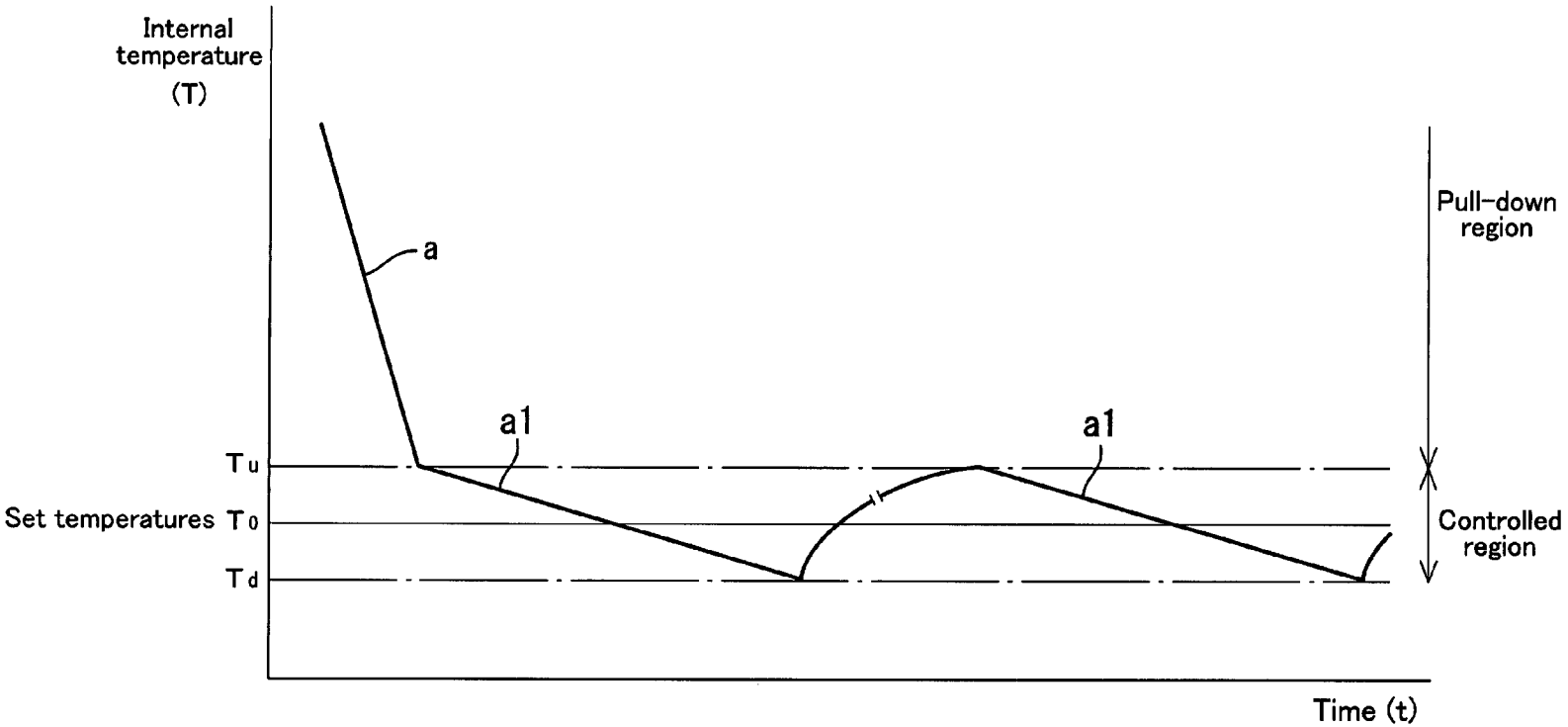
FIG. 14 is a graph comparatively showing internal temperature characteristics of a refrigerating unit and a freezing unit.
Figure 15:
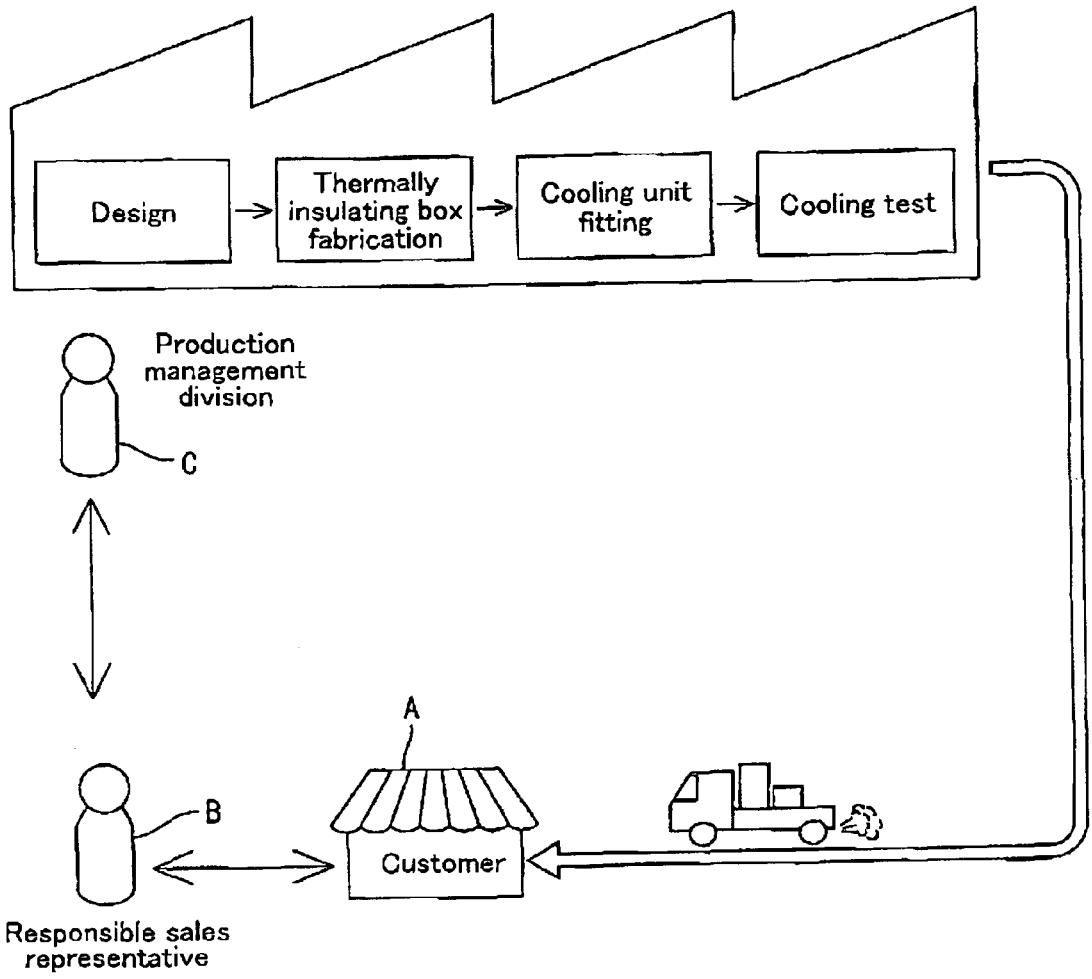
Fig. 15 (Prior Art)
FIG. 15 is a block diagram of showing the conventional method of manufacturing and selling a cooling storage unit.

The driving of the inverter compressor 32 is so controlled so as to keep the internal temperature along an ideal temperature curve during the operation of the inverter compressor 32 in the controlled region, as in the pull-down region described above. This temperature curve is represented as a straight line a1 whose slope is shallower than the ideal curve (straight line a) at the time of the pull-down cooling, as shown in FIG. 14. According to this ideal curve a1, the established target for the lowering degree of the internal temperature is also a constant, although smaller than the constant of the ideal curve a.

The ideal curve a1 is similarly stored in the data storage unit 49. The ideal curve a1 is used when the controlled cooling program, also stored in the control unit 45, is executed.

The control operation in the controlled cooling procedure is basically the same as in the pull-down cooling procedure. When the internal temperature is reduced by the pull-down cooling to the upper temperature limit Tu, higher by a prescribed degree than the set temperature To, the operation shifts to controlled cooling. The internal temperature is then detected at prescribed intervals of time. At every interval of that detection, the actual drop of the internal temperature is computed and compared with the target value (constant) of the internal temperature drop of the ideal temperature curve a1. If the computed value is found to be below the target value, the number of revolutions of the inverter compressor 32 will be increased. Conversely, if the computed value is found greater than the target value, the number of revolutions of the inverter compressor 32 will be reduced. These actions are repeated at each prescribed interval of time. Consequently, the temperature gradually falls along the ideal curve (the straight line a1).

When the internal temperature has reached the lower temperature limit Td, lower by a prescribed degree than the set temperature To, the inverter compressor 32 is turned off. At this time the internal temperature takes a gradual upturn due to the difference between the ambient temperature and the internal temperature. When the internal temperature has returned to the upper temperature limit Tu, temperature control along the temperature curve a1 is performed again. The repetition of these actions helps to keep the temperature within the box substantially at the set temperature To.

During this controlled cooling, cooling can be accomplished in an energy-saving way by utilizing the inverter compressor 32. In addition, operational intervals of the inverter compressor 32 can be established, enabling the evaporator 36 to perform a kind of defrosting function and thereby prevent a thick accumulation of frost.

Using the refrigerating side for example, an operation program is provided to so control the driving of the inverter compressor 32 as to cause the internal temperature to follow the temperature characteristic X (see FIG. 14). Temperature characteristic X includes the ideal curves a and a1 over the range of operation from pull-down cooling to controlled cooling.

Using the freezing side for example, although the basic control operation is the same, the internal set temperatures differ. Additionally, in controlled cooling the operating durations of the inverter compressor 32 are set for a shorter cycle than for the refrigerating side in order to minimize frost accumulation. This reason naturally results in different ideal curves. On the freezing side, an operation program is required to so control the driving of the inverter compressor 32 as to cause the internal temperature to follow the temperature characteristic Y in FIG. 14.

Therefore, separate operation programs for the refrigeration and freezing purposes, including the target temperature curves, are all stored in the control unit 45. The appropriate operation program is executed depending upon whether the cooling unit 30 is installed in the refrigerator compartment 15 or in the freezer compartment 16.

The freezer-refrigerator in this embodiment of the invention is structured as described above. As previously stated, the body 10 consisting of a thermally insulated box and two cooling units 30 designed for common use are separately brought onto the installation site. The two cooling units 30 are fitted into the openings 21 in the respective ceilings of the refrigerator compartment 15 and the freezer compartment 16. After that, the set internal temperatures for each of the refrigerator compartment 15 and the freezer compartment 16 are entered. In the control unit 45 attached to the cooling unit 30 fitted to the refrigerator compartment 15, the operation program for the refrigerator compartment 15 is selected by means of a switch or the like (not shown) provided in the electrical equipment box 39. In the control unit 45 attached to the cooling unit 30 fitted on the freezer compartment 16 side, the operation program for the freezer compartment 16 is selected.

Cooling by the refrigerator compartment 15 and the freezer compartment 16 are controlled under their respective operation programs.

As described, a capillary tube 35 of an intermediary characteristic flow rate between that required for refrigeration or freezing is used. Adaptation to the low-flow rate freezing region is accomplished by disposing an accumulator 42 immediately after the outlet of the evaporator 36 and thereby achieving a throttling effect. In addition, positioning the heat exchanging section 40A closer to the inlet of the capillary tube 35 in order to reduce the total resistance in the tube also accomplishes the adaptation to the high-flow rate refrigerating region. Therefore, the cooling unit 30, in which separate designs of cooling units 30 are used for refrigerating purposes and for freezing purposes according to the prior art, can be used in common for either of the two purposes. Moreover, the inverter compressor 32 is used to ensure an appropriate cooling capacity, which is determined by such conditions as the relative size of the internal storage volume of the refrigeration storage unit.

For this reason the cooling unit 30, of which many different types were conventionally made available in order to meet different conditions including the cooling requirement (refrigeration or freezing) and the relative size of the internal volume, can be applied in common to a considerably wide range of requirements. As a result, many steps involved in the designing, production and management of the cooling unit 30 can be dispensed with, making possible a substantial cost savings.

Other Embodiments

The present invention is not confined to the embodiment described with reference to the accompanying drawings. The following embodiments are also included in the technical scope of the invention, and various other modifications not specifically stated can be implemented in addition to these other embodiments without deviating from the true scope and spirit of the invention.

(1) While the "cooling requirement", "vertical or lateral", the "number of doors", "the type of door", "width", and "effective capacity", are to be specified in the received order database of the above-described embodiment as required specifications, if the customer, having reviewed a catalog or researched a Internet web site and selected a type meeting his requirement, the type identification sign representing that type (such as the box ID) can be recorded in place of the required specifications. In this case, the type identification sign and the corresponding identification sign of the thermally insulated box can be recorded and matched to one another in the thermally insulated box database.

(2) While one type of cooling unit is designed to allow for common use by every box recorded in the box DB in the foregoing embodiment, another conceivable configuration is to divide the group of thermally insulated boxes recorded in the box DB into a plurality of subgroups. A cooling unit can be specifically matched for each type of subgroup.

(3) While the foregoing embodiment uses an inverter compressor as the means of adjusting the cooling capacity of the cooling unit, the usable type of compressor is not limited to only this type of compressor. A multi-cylinder compressor with an unloading function, which adjusts the number of driven cylinders according to the load level or some other variable capacity type compressor can be used as well.

(4) Another conceivable means of adjusting the cooling capacity of the cooling unit is to control the quantity of refrigerant for the freezing circuit. For instance, a bypass circuit can be provided to return the refrigerant coming out of the condenser to the compressor without letting the refrigerant pass the evaporator. The bypass circuit may also return the refrigerant coming out of the discharge side of the compressor to the suction side of the compressor without letting the refrigerant pass the evaporator. In this way, the cooling capacity can be reduced.

(5) A temperature type expansion valve with a wide range of flow rate variations can be used as the expansion mechanism for the cooling unit.

(6) The variety of cooling requirements is not limited to refrigeration and freezing that were cited as examples for the foregoing embodiment. The internal cooling temperature can be specified for other purposes than just refrigeration and freezing. Some examples of the other purposes include constant-temperature high-humidity cooling or solid freezing. Further, there may be three or more cooling requirement purposes for selection with regard to the same cooling unit.

What is claimed is:

1. A method for manufacturing a cooling storage unit, comprising:

using box selecting means to select a thermally insulated box from a group of thermally insulating boxes, said thermally insulated box to have combined therewith at least one cooling unit, each of said at least one cooling unit including (i) a compressor, (ii) a condenser, (iii) an expansion mechanism, (iv) an evaporator, (v) refrigerant piping, and (vi) refrigerant, with said compressor, condenser, expansion mechanism and evaporator being connected via said refrigerant piping to define a circuit containing said refrigerant, and with said expansion mechanism having an intermediary characteristic flow rate between a flow rate suitable for refrigerating use and a flow rate suitable for freezing use;

transporting said thermally insulated box to a cooling storage unit installation site;

transporting said at least one cooling unit to said cooling storage unit installation site; and combining said thermally insulated box with said at least one cooling unit.

2. The method according to claim 1, wherein said expansion mechanism comprises a capillary tube, and said each of said at least one cooling unit further includes (i) an accumulator on an outlet side of said evaporator, and (ii) a heat exchanging device, capable of performing heat exchange with said refrigerant piping, on the outlet side of said evaporator and on an upstream half region of said capillary tube.

3. The method according to claim 2, wherein said compressor comprises a variable-capacity compressor, and said each of said at least one cooling unit further includes (i) memory means for storing pull-down cooling characteristics indicating a target extent of an internal temperature reduction, and (ii) operation control means for varying a capacity of said variable-capacity compressor so that an internal temperature of said thermally insulated box falls corresponding to the pull-down cooling characteristics stored in said memory means.

4. The method according to claim 3, wherein said memory means is also for storing (i) an upper temperature limit, (ii) a lower temperature limit, and (iii) a controlled cooling target extent of the internal temperature reduction, and said operation control means is also for (i) performing controlled cooling when the internal temperature of said thermally insulated box equals the upper temperature limit, (ii) ending controlled cooling when the internal temperature of said thermally insulated box equals the lower temperature limit, and (iii) varying the capacity of said variable-capacity compressor during controlled cooling so that the internal temperature of said thermally insulated box falls corresponding to the controlled cooling target extent of the internal temperature reduction.

5. The method according to claim 4, wherein said memory means is also for storing cooling requirement programs, with said each of said at least one cooling unit capable of being subjected to individual operational control according to a corresponding one of said cooling requirement programs, and said each of said at least one cooling unit further includes (i) determining means for determining cooling requirements of said thermally insulated box, and (ii) selecting means for enabling an operator to select a program from said cooling requirement programs, with said program to be executed based upon the cooling requirements as determined by said determining means.

6. A sales management system for selling to a customer a cooling storage unit, the cooling storage unit being constructed by combining a thermally insulated box with a corresponding number of cooling units, said sales management system comprising:

required specification input means for entering specifications required by the customer, the specifications including (i) a shape of the thermally insulated box, (ii) a purpose selected from the group consisting of refrigeration, freezing, and refrigeration-freezing, and (iii) a storage capacity of the cooling storage unit, a received order database for storing an order record corresponding to the specifications required by the customer;

a thermally insulated box database for storing a thermally insulated box record;

thermally insulated box searching means for searching said thermally insulated box database in an attempt to match the order record with the thermally insulated box record; and shipping instruction means for communicating a thermally insulated box, corresponding to the thermally insulated box record when matched with the order record by said thermally insulated box searching means, and the number of corresponding cooling units to respective supply sources together with customer information recorded on the order record, wherein each of the corresponding number of cooling units includes (i) a compressor, (ii) a condenser, (iii) an expansion mechanism, (iv) an evaporator, (v) refrigerant piping, and (vi) refrigerant, with said compressor, condenser, expansion mechanism and evaporator being connected via said refrigerant piping to define a circuit containing said refrigerant, and with said expansion mechanism having an intermediary characteristic flow rate between a flow rate suitable for refrigerating use and a flow rate suitable for freezing use.

* * * * *